US005151744A

United States Patent [19]

Lundy et al.

[11] Patent Number: 5,151,744

[45] Date of Patent: Sep. 29, 1992

[54] CLEANER BRUSH RETONE FILM CONTROL

[75] Inventors: Douglas A. Lundy, Webster; Kip L. Jugle, Rochester; Daniel W. MacDonald, Farmington; Robin E. Berman; Carl B. Hurwitch, both of Rochester, all of N.Y.

[73] Assignee: Xerox Corporation, Stamford, Conn.

[21] Appl. No.: 742,817

[22] Filed: Aug. 9, 1991

[51] Int. Cl.[5] ..... G03G 21/00

[52] U.S. Cl. ..... 355/296; 15/1.51; 15/256.51; 355/208; 355/301; 355/303

[58] Field of Search ..... 355/203, 204, 206, 208, 355/246, 296, 301, 306, 326, 303; 15/1.51, 256.5, 256.51, 256.52

[56] References Cited

U.S. PATENT DOCUMENTS

| | | | |
|---|---|---|---|
| 4,134,673 | 1/1979 | Fisher | 15/256.52 X |
| 4,878,093 | 10/1989 | Edmunds | 355/296 |
| 4,894,685 | 1/1990 | Shoji | 355/204 X |
| 4,945,388 | 7/1990 | Tange et al. | 355/296 |
| 4,956,677 | 9/1990 | Akiyama | 355/303 |
| 4,999,673 | 3/1991 | Bares | 355/208 |

*Primary Examiner*—A. T. Grimley
*Assistant Examiner*—J. E. Barlow, Jr.

[57] ABSTRACT

A process for controlling the amount of film buildup on a photoreceptor surface caused by certain print mode and/or material through conditions in a single pass highlight color printer which enables or promote photoreceptor filming by the DAD toner additive (i.e. zinc stearate). Such filming results in tri-level image Push defect. This process utilizes toner coated cleaner brushes to control the film buildup thus preventing the defect. This process defines a functional equation that maintains a certain toner concentration at the cleaner brush fiber tips thereby controlling photoreceptor filming.

16 Claims, 4 Drawing Sheets

CLEANER BRUSH RETONE FILM CONTROL

BACKGROUND OF THE INVENTION

This invention relates generally to a color printing machine, and more particularly, cleaning brushes to remove toner additive film particle buildup on the photoconductive member.

In a colored image forming apparatus, an electrostatic latent image which is to be developed by a predetermined color is formed on a photoconductor by an optical system of a copying machine or printer. Then, the electrostatic latent image is developed by a developing unit which accommodates a predetermined colored toner to be used for development. The developed image after development is transferred onto a transfer material, intermediate transfer belt or the like on the photoconductor. Thereafter, an electrostatic latent image which is to be developed by the next predetermined color is formed on the photoconductor by an optical system. The electrostatic latent image thus formed is developed by a developing unit which accommodates the next predetermined colored toner to be used for development. The developed image thus obtained is transferred onto the transfer material, intermediate transfer belt or the like on the photoconductor by overlaying it on the image previously transferred. This toner image may be subsequently transferred to a support surface such as copy paper to which it may be permanently affixed by heating or by the application of pressure. After each transfer process, the toner remaining on the photoconductor is cleaned by a cleaning device.

However, when colored toners other than black toner are cleaned from the photoreceptor, there is a tendency for more residual toner to remain on the photoconductor. Thus, the photoreceptor is not able to be efficiently cleaned by the same process that is used to clean black toner alone from the photoreceptor. Possible reasons for the additional filming on the photoconductor caused by the color toners are the dye, pigment or additive used in the color toners. For example, zinc stearate (ZnSt) and Aerosil are essential additives to the color toners to enhance toner flow and stabilize developer conductivity. During the printing process the ZnSt is preferentially developed in the background regions of the photoreceptor, not transferred to the print paper, and subsequently smeared on the photoreceptor by the cleaner brushes. As the ZnSt film thickens with time, Aerosil particles become embedded in the film, causing a secondary print quality defect referred to as deletions, Charge Area Development (CAD) loss, or lateral charge conductivity. It is an objective of this invention to prevent smearing of the additive on the photoreceptor, remove additive film from the surface of the photoconductive member and to prevent the print quality defects caused by the embedded particles.

Certain print mode and/or material throughput conditions (i.e. throughput occurs when a high rate of material is being added and removed from developer housings; or when greater than 5% color area coverage occurs) in a single pass highlight color printer enable or promote photoreceptor filming by the Discharge Area Development (DAD) toner additive zinc stearate (ZnSt). Such film is the origin of the tri-level Image Push defect. Image Push defect is: (1) when the color image is moved going through the black housing. This is made worse when Zn St film is present and decreases the coefficient of friction between the toner and photoreceptor. (2) the movement of the color toner during the black development cycle due to the loss of coefficient of friction on the photoreceptor by the slippery Zn St film.

Various ideas as to how to improve cleaning efficiency have been disclosed. One publication suggested mixing toner with a small amount of low adhesive polymeric additive in smaller average particle size than that of the toner of each developer. Another publication discloses each developer being mixed with an abrasive for removing matter adhered to the photoconductor when the cleaning process is conducted. Yet another publication discloses an idea for removing a matter adhered to the photoconductor with a resin by providing a grinding device aside from a cleaning device.

However, in the colored image forming apparatus, it is a laborious task to mix the proper amount of suitable polymeric additive or abrasive with each developer and it eventually becomes expensive. Moreover, it is not preferable for use in forming a colored image which requires a delicate tone since it badly affects the clearness of color and permeability when the additive or abrasive are mixed with a colored toner other than black toner.

Various cleaning techniques have hereinbefore been used as illustrated by the following disclosures, which may be relevant to certain aspects of the present invention:

U.S. Pat. No. 4,945,388 to Tange et al. describes a method and apparatus for cleaning a color image from a photoreceptor wherein a black toner only image is transferred onto the photoreceptor periodically when the color developing units are actuated, without any transfer process, to remove residual black toner. A black toner only image is fixed to the photoreceptor during machine startup and after a certain number of copies.

Co-pending application, Ser. No. 07/56798 to Frankel et al., filed Aug. 20, 1990, describes an imaging device with a brush cleaner loaded with one type of toner to abrade the photoreceptor to remove the second type of toner.

SUMMARY OF INVENTION

In accordance with one aspect of the present invention, there is provided a method of replenishing particles on a cleaner brush adapted to contact a photoreceptor used in a printing machine of the type having at least two different color developer units and a sheet feeder for advancing a sheet to a transfer station for transferring an image developed in the photoreceptor to the sheet, comprising the following steps. De-energizing the sheet feeder, transfer station and one of the developer units. Recording a latent image in the photoreceptor. Developing the latent image with particles from the other developer unit. Removing the particles from the photoreceptor with the cleaning brush so that particles adhere to the brush preventing smearing on the photoreceptor and abrading film from the photoreceptor.

Pursuant to another aspect of the present invention, there is provided an apparatus for replenishing particles on a cleaner brush adapted to contact a photoreceptor used in a printing machine of the type having at least two different color developer units and a sheet feeder for advancing a sheet to a transfer station for transferring an image developed in the photoreceptor to the sheet, comprising the following. Means for de-energizing the sheet feeder, transfer station and one of the developer units. Means for recording a latent image in the photoreceptor. Means for developing the latent image with particles from the other developer unit. Means of removing the particles from the photoreceptor with the cleaning brush so that particles adhere to the brush preventing smearing on the photoreceptor and abrading film from the photoreceptor.

BRIEF DESCRIPTION OF THE DRAWINGS

Other objects and advantages of the present invention will become apparent upon reading the following detailed description and upon reference to the drawings, in which.

Figure 4:
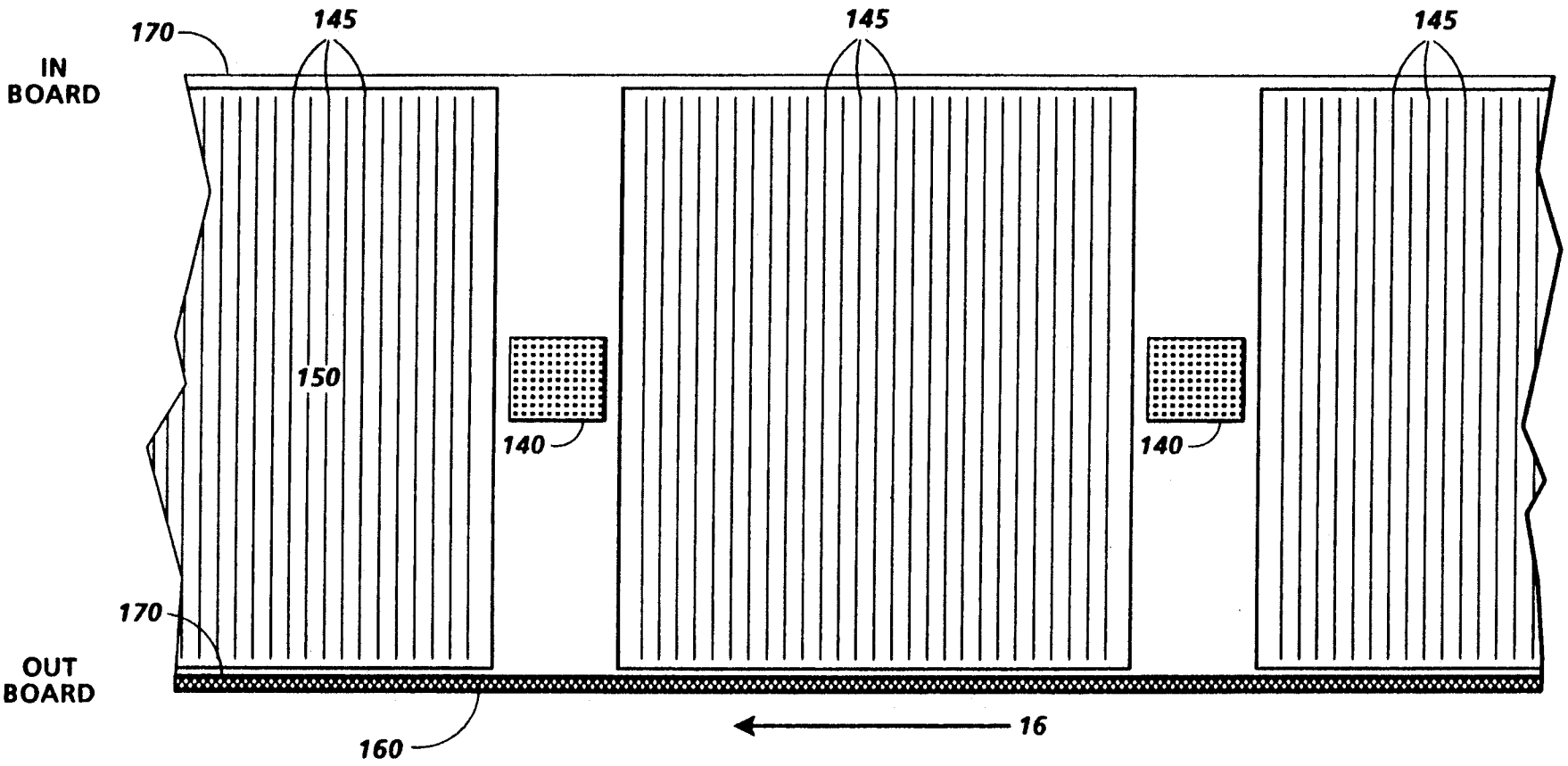

(a) is a schematic of a brush fiber contacting a toner additive particle;

(b) is a schematic of black toner attached to the fiber tips of the brush;

(c) is a schematic of black toner and aerosil attached to the fiber tips of the brush as the brush fiber contacts a toner additive particle; and FIG. 4 shows a schematic of the cleaner brush retone image area on a photoreceptor.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
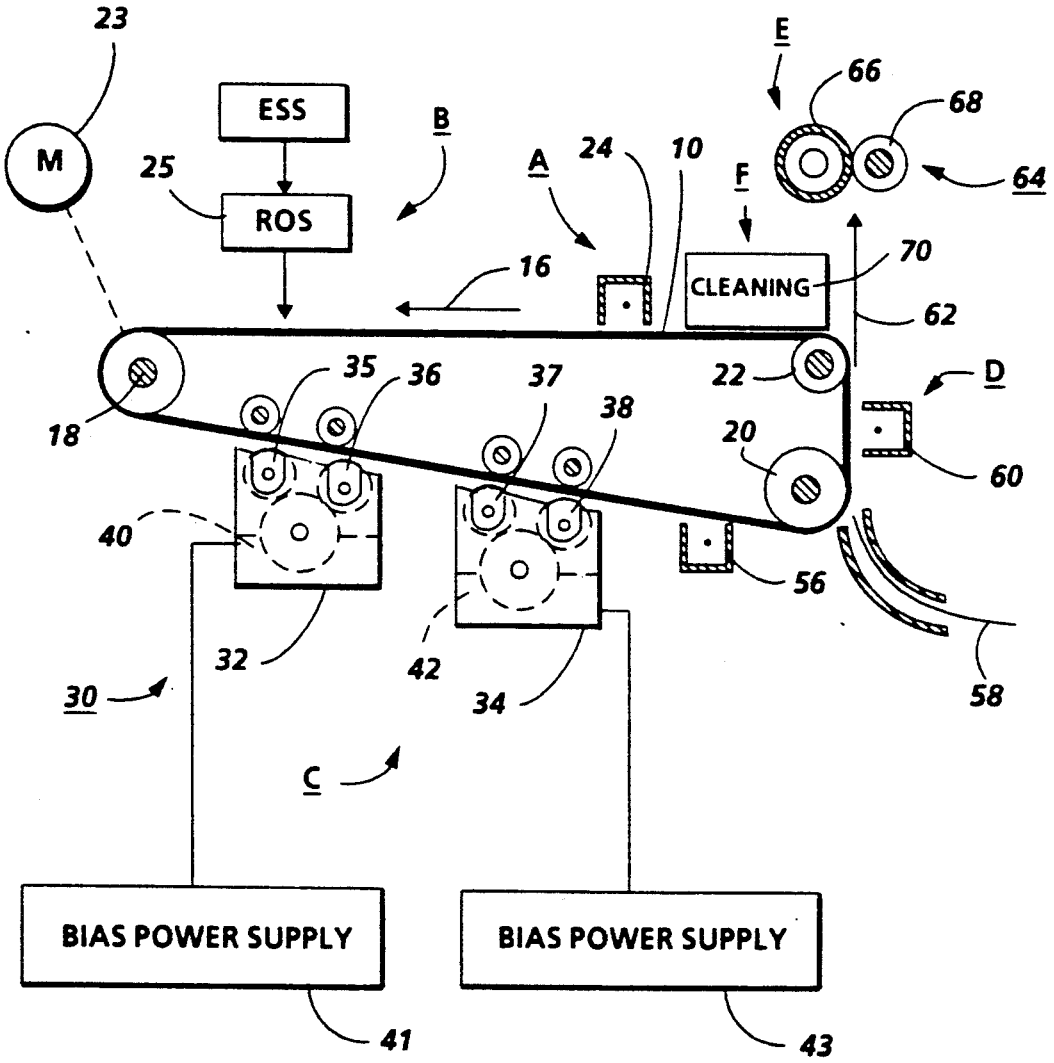
FIG. 1 is a schematic illustration of a printing apparatus incorporating the inventive features of the invention.

For a general understanding of an electrostatographic printing machine in which the present invention may be incorporated, reference is made to FIG. 1 which depicts schematically the various components thereof. Hereinafter, like reference numerals will be employed throughout to designate identical elements. Although the cleaning apparatus of the present invention is particularly well adapted for use in an electrostatographic printing machine, it should become evident from the following discussion, that it is equally well suited for use in a wide variety of devices and is not necessarily limited to the particular embodiments shown herein.

Referring now to the drawings, where the showings are for the purpose of describing a preferred embodiment of the invention and not for limiting same, the various processing stations employed in the reproduction machine illustrated in FIG. 1 will be briefly described.

A reproduction machine in which the present invention finds advantageous use utilizes a charge retentive member in the form of a photoconductive belt 10 consisting of a photoconductive surface and an electrically conductive, light transmissive substrate and mounted for movement past a charging station A, an exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 1, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). The resulting photoreceptor contains both charged-area images and discharged-area images as well as charged edges corresponding to portions of the photoreceptor outside the image areas. [The high voltage latent image is developed with positive (+) charged black toner and is called Charge Area Development (CAD). The low voltage latent image is developed with negative (−) charge color toner and Discharge Area Development (DAD)].

The photoreceptor, which is initially charged to a voltage undergoes dark decay to a voltage level. When exposed at the exposure station B it is discharged to near zero or ground potential in the highlight (i.e. color other than black) color parts of the image. The photoreceptor is also partially discharged in the background (white) image areas. After passing through the exposure station, the photoreceptor contains charged areas and discharged areas which corresponding to two images and to charged edges outside of the image areas.

At development station C, a development system, indicated generally by the reference numeral 30 advances developer materials into contact with the electrostatic latent images. The development system 30 comprises first and second developer apparatuses 32 and 34. The developer apparatus 32 comprises a housing containing a pair of magnetic brush rollers 35 and 36. The rollers advance developer material 40 into contact with the photoreceptor for developing the discharged-area images. The developer material 40 by way of example contains negatively charged color toner. Electrical biasing is accomplished via power supply 41 electrically connected to developer apparatus 32. A DC bias is applied to the rollers 35 and 36 via the power supply 41.

The developer apparatus 34 comprises a housing containing a pair of magnetic brush rolls 37 and 38. The rollers advance developer material 42 into contact with the photoreceptor for developing the charged-area images. The developer material 42 by way of example contains positively charged black toner for developing the charged-area images. Appropriate electrical biasing is accomplished via power supply 43 electrically connected to developer apparatus 34. A DC bias is applied to the rollers 37 and 38 via the bias power supply 43.

Because the composite image developed on the photoreceptor consists of both positive and negative toner, a pre-transfer corona discharge member 56 is provided to condition the toner for effective transfer to a substrate using corona discharge of a desired polarity, either negative or positive.

Sheets of substrate or support material 58 are advanced to transfer station D from a supply tray, not shown. Sheets are fed from the tray with sheet feeder, also not shown, and advanced to transfer station D through a corona charging device 60. After transfer, the sheet continues to move in the direction of arrow 62 to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a backup roller 68 with the toner powder images contacting fuser roller 66. In this manner, the toner powder image is permanently affixed to the sheet.

After fusing, copy sheets are directed to catch tray, not shown or a finishing station for binding, stapling, collating etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually.

Residual toner and debris remaining on photoreceptor belt 10 after each copy is made, may be removed at cleaning station F with a brush cleaning system 70.

Figure 2:
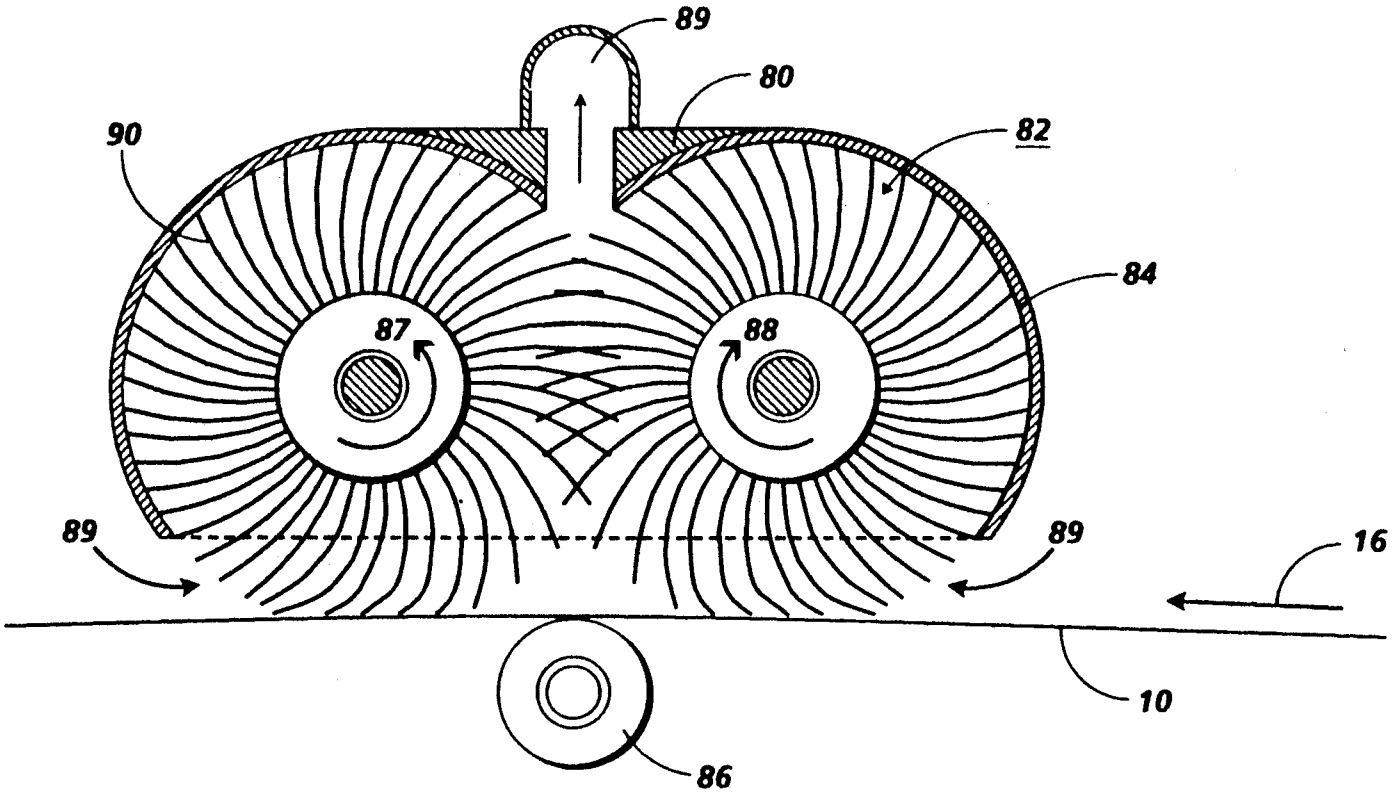
FIG. 2 is a schematic of a dual insulative cleaning brush system with flicker bars.

Referring now to FIG. 2 which shows a cleaning brush system. The fiber brushes 82 are located in a cleaner housing 84. The fibers 90 rotate against the photoreceptor 10 surface supported by a cleaning roll 86. The dual insulated fiber brushes 82 rotate in opposite directions 87, 88. When these insulated fiber brushes 82 rub against the charging bars (or flicker bars) 80, the triboelectric charge produced will attract and hold one of the toners, either positive (+) or negative (−) depending on the selection of the charging bar and fiber. In the case of the present invention's system the mono filament brush fiber 90 rubbing against charging bars 80 (e.g. teflon) produce a high negative (−) field thus attracting and holding the positive (+) black toner. By using the selected fiber brush material (e.g. kanecaron) and flicker bars (or charging bars) (e.g. made of teflon) 80 the positive black toner is held to the brush fiber tip. An air vacuum 89 is used to remove debris from the brush fibers 90.

Alternatively, a different fiber to bar combination that produces a high positive (+) charge would attract and hold the color negative (−) type toners. The specific print mode in which the Image Push defect is initiated is during color executive mode when only color toner is being used, and the additive (ZnSt) is being preferentially developed.

Figure 3A:
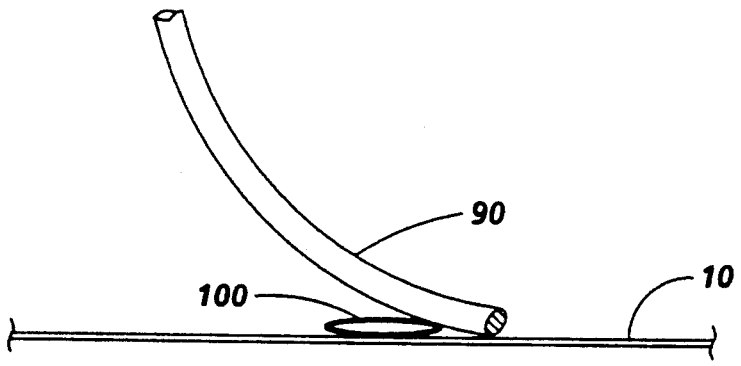
FIG. 3.
Figure 3B:
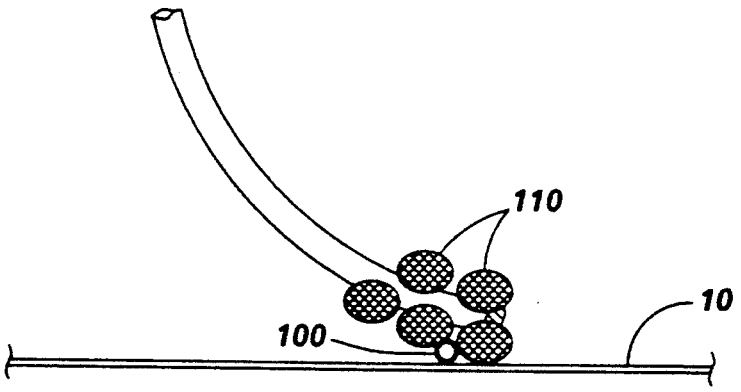
Figure 3C:
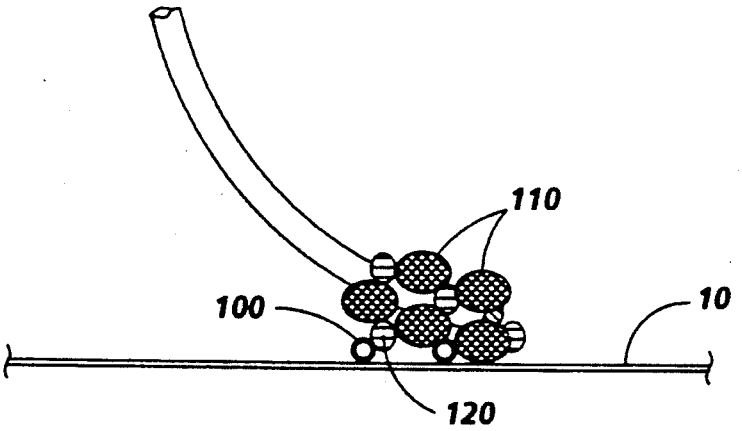

Referring now to FIGS. 3(*a*), 3(*b*), and 3(*c*). FIG. 3(*a*) shows what occurs in the typical mode of cleaning the photoreceptor. The brush fiber 90 as it rotates against the photoreceptor 10 contacting the surface has a tendency to smear the additive particles 100 (e.g. ZnSt). The smearing results from the force of the brush fibers 90 rotational momentum as they land on the additive particle. The present invention of adding positively charged toner to the fiber tips of the cleaning brushes 82 (see FIG. 2) to avoid additive smearing and to control additive film buildup can perform in one of the following ways shown in FIGS. 3(*b*) or 3(*c*). In FIG. 3(*b*), it is shown how the black toner (positive) 110 attaches to the fiber 90 tip to provide a sort of buffer between the individual fibers 90 and the photoreceptor 10 surface thereby, preventing the brush fibers from smearing the additive particles 100 as the fibers 90 rotate. FIG. 3(*c*) shows the attachment of black toner (positive) 110 and Aerosil particles 120 to the brush fibers 90. The Aerosil particles 120 abrade the additive particles 100 (e.g. ZnSt) film from the photoreceptor 10 surface.

Referring now to the specific subject matter of the present invention, shown in FIG. 4, is a control process to monitor the black toner throughput. As shown in FIG. 4, a mass of black toner is placed in the image area 150 in a line pattern. This image area 150 with black toner is called the cleaner brush retone area. The line pattern of toner in the image area are called zip tone lines 145. The zip tone lines 145 form a line pattern of 8 pixels on, 8 pixels off, providing approximately 40% area coverage of the image area. A process control patch 140 exists in the interdocument area (i.e. the non-image area). In this invention, after the mass of black toner on the cleaner brushes drops below an acceptable limit, the printer will enter the brush retone procedure and begin imaging an internal 14" black detone image. A process control patch 140 exists in the interdocument area (i.e. the non-image area). Untransferred images (narrow black lines) will pass to the cleaner. The retoning continues until the mass of black toner on the cleaner brushes reaches an upper limit. Depending on the detoned state of brushes, all or part of the toner will be attached to the fibers. The machine will resume normal operation and the brushes will begin giving up the black toner. This process is cyclical and can be continued for an unlimited volume. This process is called Cleaner Brush Retone or CBR. The process direction is indicated by the arrow 16, photoreceptor edges by 170, and the ground strip by 160.

During the color executive print mode, periodically and automatically turn-off the color development and paper feed systems, turn on the black development system, adjust the pre-transfer, transfer, and preclean dicorotrons and initiate black only imaging in a zip tone (line pattern) type document. Without paper feed and with selected dicorotron treatment, the untransferred toner is fully removed from the photoreceptor by the cleaner brushes. The negative field generated on the brush fibers will attract and hold the low charged black toner presented to the cleaner during this time thus providing a renewable brush conditioning.

In order to prevent the aerosil/zinc stearate film formation, a control algorithm which tracks the approximate rate of black toner being sent to the cleaner as a function of print count in used in the cleaner brush retone (CBR) process of the present invention. When the throughput minus the toner depletion weight reaches a predetermined limit, the controls will enact a retone routine which will retone the cleaner brushes.

The base equation is:

$$Mb = Mbn - (xxx)Np + (yyy)Pi + 5(yyy)Pm$$

where: Mb is the mass of black toner in the cleaner brush in tenths of a milligram. Mb will be allowed to vary from 0 to 30,000. Np is the number of pitches during which the cleaner brush is turning and (xxx) is a non volatile memory (NVM) variable which describes the slope of the toner removal rate. Initial value for (xxx) is 30. Maximum range will be 0–255. Pi is the black pixel count in the image area in units of 218 pixels (i.e. 2 to the 18th power). (yyy) is an NVM variable which represents the efficiency with which the cleaner brush retains the black toner sent to it. Initial value for (yyy) is 22. The maximum range will be 1–255. Pm is the pixel count in the interdocument area in units of 218 pixels. It is multiplied by 5 because the toner is not transferred. Hence the amount of toner that reaches the cleaner per pixel is approximately 5 times that which reaches the cleaner from the transferred image area.

Mb will be capped at 30,000 which is the assumed saturation mass of toner in the brush. When (yyy) Pi+5 (yyy) Pm is less than (xxx) Np, Mb will be decremented until a lower bound (zzz) is reached. The lower bound will be an NVM variable which will be between 0 and 30,000. The initial value will be 15,000.

When the lower boundary is reached, the printer will interrupt the printing process and force dead cycles to perform the following functions: color housing will be left on to maintain standard tri-level electrostatics; black housing will be turned on; pre-transfer shield voltage, transfer current, and preclean current will be set to special temporary NVM selectable value; paper feeding will be inhibited; tri-level electrostatics will be maintained; the 14 inch black detone document will be run. For each black detoned document Mb will be incremented by (yyy)Pi. This will continue until Mb is equal the 30,000 cap. Runtime feed forward pixel counting and IRD control will be maintained for toner dispense during this routine. After completing the designated number of black detone images, one additional cleaning belt cycle will be run before returning the machine to normal run mode. Since electrostatics will be maintained during the run, there will be no need for a cycle up convergence.

Mb will be neither incremented nor decremented during any state other than normal tri-level, black executive or color executive mode run time. All pixel counting and pitch counting will be suspended during diagnostics, TXC (total xerographic convergence), TC (toner concentration) adjust, electrostatic adjust and cycle up. Note this routine will be invoked only during normal tri-level, black executive or color executive mode running.

For a new build machine or when new cleaner brushes are installed in the field, a full retoning of the brushes will be required. A new diagnostic routine will be required to run a programmable number (10, 20, 30, 40, or 50) of prints in the retone mode and set the Mbn variable to 30,000. For this diagnostic routine the tri-level mode will be used. All other control conditions will be identical to the runtime routine.

While the methods used in these process inventions are described in terms of the black (i.e. positive) toner to attract negatively charged film particles, the methods described herein are reversible for negative (−) toners.

In recapitulation, the present invention is a process for providing a renewable source of toner to the cleaner brushes thus controlling additive buildup. It is evident that the addition of toner to the cleaner brushes will remove the additive buildup common in color toner. It is also evident that the charge on the brushes can be switched to allow effective cleaning of oppositely charged filming on the photoreceptor surface. The advantage of CBR is that is can be used in the color exec. mode of development.

It is, therefore, apparent that there has been provided in accordance with the present ivention, processes for providing a renewable source of toner to the cleaner brushes thus controlling additive buildup that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method of replenishing particles of a first polarity in a cleaner brush adapted to contact a photoreceptor used in a printing machine of the type having at least two different color developer units and a sheet feeder for advancing a sheet to a transfer station for transferring an image, having particles of a second polarity opposite in polarity to the first polarity, developed on the photoreceptor to the sheet, comprising the steps of:

de-energizing the sheet feeder, transfer station and one of the developer units;

recording a latent image on the photoreceptor in an image region;

developing the latent image with particles of the first polarity from the other developer unit; and removing the first polarity particles from the photoreceptor with the cleaning brush so that the first polarity particles adhere to the brush, and, subsequently, removing the second polarity particles from the photoreceptor with the cleaning brush having the first polarity particles adhering thereto preventing smearing on the photoreceptor and abrading film therefrom.

2. The method of claim 1, further comprising the steps of:

comparing the mass of the first polarity particles adhering to the cleaner brush to a predetermined reference; and performing said steps of de-energizing, recording, developing and removing in response to said step of comparing determining that the mass of the first polarity particles adhering to the cleaner brush is less than the predetermined reference.

3. The method of claim 2, further comprising the step of energizing the sheet feeder transfer station and other developer unit in response to said comparing means determining that the mass of the first polarity particles adhering to the cleaner brush is at least equal to the predetermined reference to resume normal operation of the printing machine.

4. The method of claim 3, wherein the latent image recorded in the photoreceptor during said step of recording comprises a line pattern.

5. The method of claim 4, wherein said step of de-energizing comprises de-energizing the developer unit having non-black particles.

6. The method of claim 5, wherein said step of developing comprises developing the latent image with black particles.

7. The method of claim 4, wherein said step of de-energizing comprises de-energizing the developer unit having black particles.

8. The method of claim 7, wherein said step of developing comprises developing the latent image with non-black particles.

9. An apparatus for replenishing particles of a first polarity in a cleaner brush adapted to contact a photoreceptor used in a printing machine of the type having at least two different color developer units and a sheet feeder for advancing a sheet to a transfer station for transferring an image, having particles of a second polarity, opposite in polarity to the first polarity, developed on the photoreceptor to the sheet, comprising:

means of de-energizing the sheet feeder, transfer station and one of the developer units;

means of recording a latent image on the photoreceptor;

means of developing the latent image with the first polarity particles from the other developer unit; and means of removing the first polarity particles from the photoreceptor with said cleaning brush so that the first polarity particles adhere thereto and, subsequently, removing the second polarity particles from the photoreceptor with said cleaning brush, having the first polarity particles adhering thereto, preventing smearing on the photoreceptor and abrading film therefrom.

10. The apparatus as recited in claim 9, further comprising:

means for comparing the mass of the first polarity particles adhering to the cleaner brush to a predetermined reference; and means for performing said steps of de-energizing, recording, developing and removing in response to said step of comparing determining that the mass of the first polarity particles adhering to the cleaner brush is less than the predetermined reference.

11. The apparatus as recited in claim 10, further comprising means for energizing the sheet feeder, transfer station and other developer unit in response to said comparing means determining that the mass of the first polarity particles adhering to the cleaner brush is at least equal to the predetermined reference to resume normal operation of the printing machine.

12. The apparatus as recited in claim 11, wherein the latent image recorded in the photoreceptor during said means for recording comprises a line pattern.

13. The apparatus as recited in claim 12, wherein said means for de-energizing comprises de-energizing the developer unit having non-black particles.

14. The apparatus as recited in claim 13, wherein said means for developing comprises developing the latent image with black particles.

15. The apparatus as recited in claim 12, wherein said means for de-energizing comprises de-energizing the developer unit having black particles.

16. The apparatus as recited in claim 15, wherein said means for developing comprises developing the latent image with non-black particles.

* * * * *